US009751228B2

(12) United States Patent
Heubach et al.

(10) Patent No.: US 9,751,228 B2
(45) Date of Patent: Sep. 5, 2017

(54) SHAVING CARTRIDGES HAVING THERMAL SENSORS

(71) Applicant: The Gillette Company, Boston, MA (US)

(72) Inventors: Klaus Heubach, Koenigstein (DE); Norbert Broemse, Bad Homburg (DE); Timo Schmitt, Hintertiefenbach (DE); Maurice Schirmer, Schwalbach am Taunus (DE); Felix Koenig, Darmstadt (DE)

(73) Assignee: The Gillette Company LLC, Boston, MA (US)

( * ) Notice: Subject to any disclaimer, the term of this patent is extended or adjusted under 35 U.S.C. 154(b) by 257 days.

(21) Appl. No.: 14/552,554

(22) Filed: Nov. 25, 2014

(65) Prior Publication Data

US 2015/0197018 A1 Jul. 16, 2015

Related U.S. Application Data

(60) Provisional application No. 61/927,140, filed on Jan. 14, 2014.

(51) Int. Cl.

| | |
|---|---|
| ***B26B 21/40*** | (2006.01) |
| ***B26B 21/52*** | (2006.01) |
| ***B26B 21/48*** | (2006.01) |

(52) U.S. Cl.

CPC ..... *B26B 21/4056* (2013.01); *B26B 21/4062* (2013.01); *B26B 21/4081* (2013.01); *B26B 21/48* (2013.01); *B26B 21/526* (2013.01)

(58) Field of Classification Search

CPC ..... B26B 21/4056; B26B 21/4062; B26B 21/4081; B26B 21/48; B26B 21/526; B26B 21/16; B26B 21/40; B26B 21/165

(Continued)

(56) References Cited

U.S. PATENT DOCUMENTS 2,063,808 A 12/1936 Henderson et al.
6,817,101 B1 * 11/2004 Bohmer ..... B26B 21/48 30/140

(Continued)

FOREIGN PATENT DOCUMENTS

EP 1535708 A1 11/2004
FR 2 716 402 8/1995

(Continued)

OTHER PUBLICATIONS

PCT International Search Report with Written Opinion for corresponding international application PCT/US2015/010955 dated Apr. 17, 2015.

(Continued)

*Primary Examiner* — Ghassem Alie
(74) *Attorney, Agent, or Firm* — John M. Lipchitz; Kevin C. Johnson; Steven W. Miller

(57) ABSTRACT

A shaving razor system with a heating element for transferring heat during a shaving stroke. The heating element has a skin contacting surface. An insulating member for delivering heat to the heating element has a plurality of spaced apart thermal sensors are mounted to the insulating member and positioned below the skin contacting surface. An electrical circuit is configured to deliver energy to the insulating member. The electrical circuit has a control circuit for temperature regulation. A power source is in communication with the electrical circuit. The thermal sensors measure the temperature of the heating element and are in communication with the control circuit.

14 Claims, 5 Drawing Sheets

(58) Field of Classification Search
USPC ..... 30/34, 34.5, 140, 42, 44–46; 327/528
See application file for complete search history.

(56) References Cited

U.S. PATENT DOCUMENTS

| | | | | |
|---|---|---|---|---|
| 8,479,624 | B2 | 7/2013 | Flyash et al. | |
| 8,510,958 | B2 | 8/2013 | Hart et al. | |
| 8,516,706 | B2 | 8/2013 | Flyash et al. | |
| 8,615,886 | B1 * | 12/2013 | Childers | B26B 21/4056 30/34.05 |
| 2003/0226258 | A1 * | 12/2003 | Patrick | B26B 19/382 30/34.05 |
| 2006/0032054 | A1 * | 2/2006 | Simms | B26B 21/4056 30/34.05 |
| 2006/0070242 | A1 | 4/2006 | Szczepanowski et al. | |
| 2007/0271714 | A1 * | 11/2007 | Adam | A61C 17/222 15/22.2 |
| 2009/0119923 | A1 | 5/2009 | Hart et al. | |
| 2009/0255123 | A1 * | 10/2009 | Tomassetti | B26B 21/48 30/34.05 |
| 2010/0024615 | A1 * | 2/2010 | Rebaudieres | B26B 21/14 83/14 |
| 2010/0031510 | A1 * | 2/2010 | Gester | B26B 21/48 30/34.05 |
| 2011/0126413 | A1 | 6/2011 | Szczepanowski et al. | |
| 2011/0167640 | A1 * | 7/2011 | Flyash | B26B 21/48 30/34.05 |
| 2012/0167392 | A1 * | 7/2012 | Cherian | G01N 33/48785 30/34.05 |
| 2012/0233864 | A1 | 9/2012 | Flyash et al. | |
| 2012/0266465 | A1 | 10/2012 | Hart et al. | |
| 2012/0279070 | A1 | 11/2012 | Seo | |

FOREIGN PATENT DOCUMENTS

| | | |
|---|---|---|
| KR | 10-2014-0040880 | 4/2014 |
| KR | 10-20134-0042230 | 4/2014 |
| WO | WO 92/13684 | 8/1992 |

OTHER PUBLICATIONS

U.S. Appl. No. 14/552,836, filed Nov. 25, 2014, Matthew J. Hodgson et al.
U.S. Appl. No. 14/552,851, filed Nov. 25, 2014, Matthew J. Hodgson et al.
U.S. Appl. No. 14/552,879, filed Nov. 25, 2014, Matthew J. Hodgson et al.

* cited by examiner

SHAVING CARTRIDGES HAVING THERMAL SENSORS

FIELD OF THE INVENTION

The present invention relates to shaving razors and more particularly to heated razors for wet shaving.

BACKGROUND OF THE INVENTION

Users of wet-shave razors generally appreciate a feeling of warmth against their skin during shaving. The warmth feels good, resulting in a more comfortable shaving experience. Various attempts have been made to provide a warm feeling during shaving. For example, shaving creams have been formulated to react exothermically upon release from the shaving canister, so that the shaving cream imparts warmth to the skin. Also, razor heads have been heated using hot air, heating elements, and linearly scanned laser beams, with power being supplied by a power source such as a battery. Razor blades within a razor cartridge have also been heated. The drawback with heated blades is they have minimal surface area in contact with the user's skin. This minimal skin contact area provides a relatively inefficient mechanism for heating the user's skin during shaving. However the delivery of more to the skin generates safety concerns (e.g., burning or discomfort).

Accordingly, there is a need to provide a shaving razor capable of delivering safe and reliable heating that is noticeable to the consumer during a shaving stroke.

SUMMARY OF THE INVENTION

The invention features, in general, a simple, efficient shaving razor system having a housing with a guard, a cap, and one or more blades located between the guard and the cap. The guard is positioned in front of the one or more blades and the cap is positioned behind the one or more blades. A heating element is mounted to the housing for transferring heat during a shaving stroke. The heating element includes a skin contacting surface. An insulating member for delivering heat to the heating element is positioned below the skin contacting surface. An electrical circuit configured to deliver energy to the insulating member is provided. The electrical circuit includes a control circuit for temperature regulation. A power source is in communication with the electrical circuit. A plurality of spaced apart thermal sensors are mounted to the insulating member and positioned below the skin contacting surface. The thermal sensors measure the temperature of the heating element and are in communication with the control circuit.

The details of one or more embodiments of the invention are set forth in the accompanying drawings and the description below. It is understood that certain embodiments may combine elements or components of the invention, which are disclosed in general, but not expressly exemplified or claimed in combination, unless otherwise stated herein. Other features and advantages of the invention will be apparent from the description and drawings, and from the claims.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings.

DETAILED DESCRIPTION OF THE INVENTION

Figure 1:
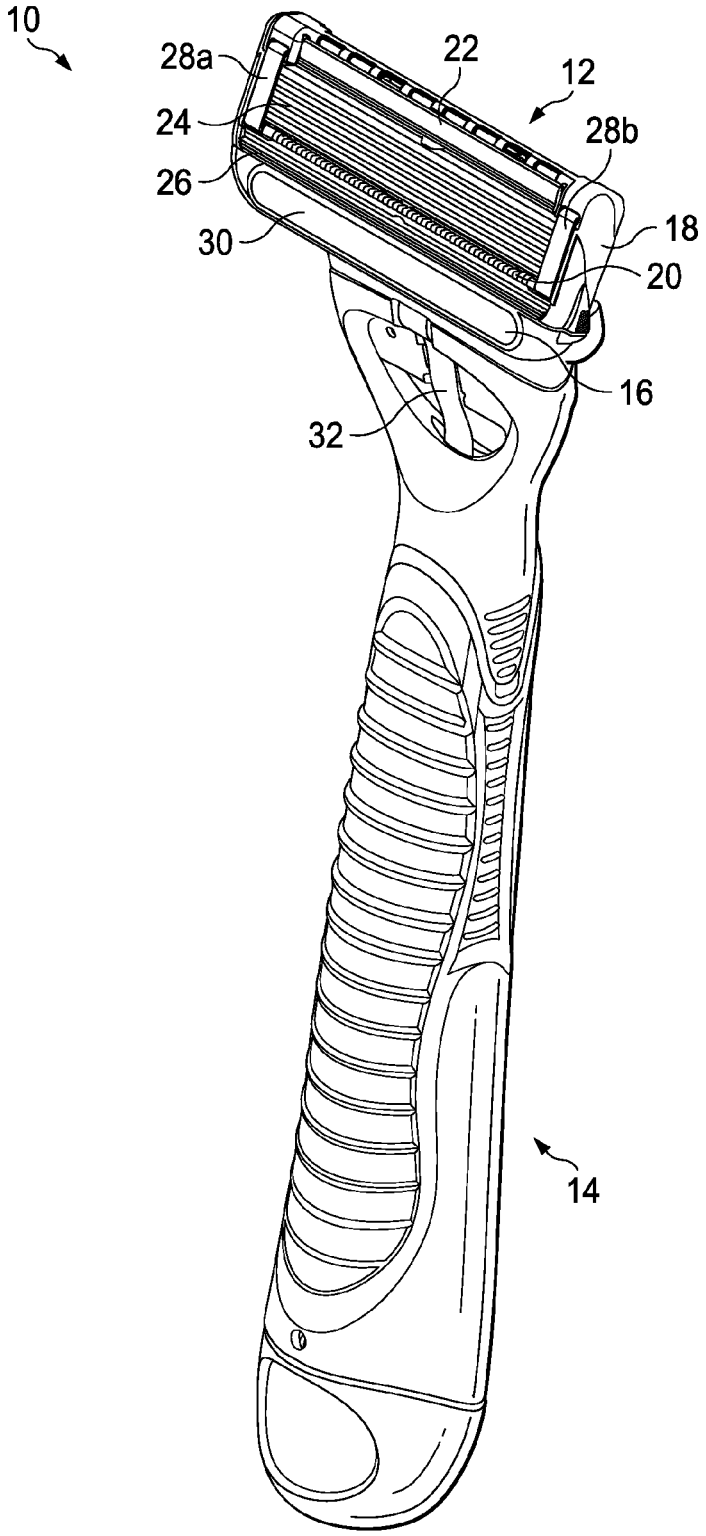
FIG. 1 is a perspective view of one possible embodiment of a shaving razor system.

Referring to FIG. 1, one possible embodiment of the present disclosure is shown illustrating a shaving razor system 10. In certain embodiments, the shaving razor system 10 may include a shaving razor cartridge 12 mounted to a handle 14. The shaving razor cartridge 12 may be fixedly or pivotably mounted to the handle 14 depending on the overall desired cost and performance. The handle 14 may hold a power source, such as one or more batteries (not shown) that supply power to a heating element 16. In certain embodiments, the heating element 16 may comprise a metal, such as aluminum or steel.

The shaving razor cartridge 12 may be permanently attached or removably mounted from the handle 14, thus allowing the shaving razor cartridge 12 to be replaced. The shaving razor cartridge 12 may have a housing 18 with a guard 20, a cap 22 and one or more blades 24 mounted to the housing 18 between the cap 22 and the guard 20. The guard 20 may be toward a front portion of the housing 18 and the cap 22 may be toward a rear portion of the housing 18 (i.e., the guard 20 is in front of the blades 24 and the cap is behind the blades 24). The guard 20 and the cap 22 may define a shaving plane that is tangent to the guard 20 and the cap 22. The guard 20 may be a solid or segmented bar that extends generally parallel to the blades 24. In certain embodiments, the heating element 16 may be positioned in front of the guard 20. The heating element 16 may comprise a skin contacting surface 30 that delivers heat to a consumer's skin during a shaving stroke for an improved shaving experience. The heating element may be mounted to either the shaving razor cartridge 12 or to a portion of the handle 14.

In certain embodiments, the guard 20 may comprise a skin-engaging member 26 (e.g., a plurality of fins) in front of the blades 24 for stretching the skin during a shaving stroke. In certain embodiments, the skin-engaging member 24 may be insert injection molded or co-injection molded to the housing 18. However, other known assembly methods may also be used such as adhesives, ultrasonic welding, or mechanical fasteners. The skin engaging member 26 may be molded from a softer material (i.e., lower durometer hardness) than the housing 18. For example, the skin engaging member 26 may have a Shore A hardness of about 20, 30, or 40 to about 50, 60, or 70. The skin engaging member 26 may be made from thermoplastic elastomers (TPEs) or rubbers; examples may include, but are not limited to silicones, natural rubber, butyl rubber, nitrile rubber, styrene butadiene rubber, styrene butadiene styrene (SBS) TPEs, styrene ethylene butadiene styrene (SEBS) TPEs (e.g., Kraton), polyester TPEs (e.g., Hytrel), polyamide TPEs (Pebax), polyurethane TPEs, polyolefin based TPEs, and blends of any of these TPEs (e.g., polyester/SEBS blend). In certain embodiments, skin engaging member 26 may comprise Kraiburg HTC 1028/96, HTC 8802/37, HTC 8802/34, or HTC 8802/11 (KRAIBURG TPE GmbH & Co. KG of Waldkraiburg, Germany). A softer material may enhance skin stretching, as well as provide a more pleasant tactile feel against the skin of the user during shaving. A softer material may also aid in masking the less pleasant feel of the harder material of the housing 18 and/or the fins against the skin of the user during shaving.

In certain embodiments, the blades 24 may be mounted to the housing 18 and secured by one or more clips 28*a* and 28*b*. Other assembly methods known to those skilled in the art may also be used to secure and/or mount the blades 24 to the housing 18 including, but not limited to, wire wrapping, cold forming, hot staking, insert molding, ultrasonic welding, and adhesives. The clips 28*a* and 28*b* may comprise a metal, such as aluminum for conducting heat and acting as a sacrificial anode to help prevent corrosion of the blades 24. Although five blades 24 are shown, the housing 18 may have more or fewer blades depending on the desired performance and cost of the shaving razor cartridge 12.

In certain embodiments, it may be desirable to provide heat in front of the blades 24. For example, the heating element 16 may be positioned in front of the guard 20 and/or the skin engaging member 26. The heating element 16 may have a skin contacting surface 30 for delivering heat to the skin's surface during a shaving stroke. As will be described in greater detail below, the heating element 16 may be mounted to the housing 18 and in communication with the power source (not shown). The heating element 16 may be connected to the power source with a flexible circuit 32.

The cap 22 may be a separate molded (e.g., a shaving aid filled reservoir) or extruded component (e.g., an extruded lubrication strip) that is mounted to the housing 18. In certain embodiments, the cap 22 may be a plastic or metal bar to support the skin and define the shaving plane. The cap 22 may be molded or extruded from the same material as the housing 18 or may be molded or extruded from a more lubricious shaving aid composite that has one or more water-leachable shaving aid materials to provide increased comfort during shaving. The shaving aid composite may comprise a water-insoluble polymer and a skin-lubricating water-soluble polymer. Suitable water-insoluble polymers which may be used include, but are not limited to, polyethylene, polypropylene, polystyrene, butadiene-styrene copolymer (e.g., medium and high impact polystyrene), polyacetal, acrylonitrile-butadiene-styrene copolymer, ethylene vinyl acetate copolymer and blends such as polypropylene/polystyrene blend, may have a high impact polystyrene (i.e., Polystyrene-butadiene), such as Mobil 4324 (Mobil Corporation).

Suitable skin lubricating water-soluble polymers may include polyethylene oxide, polyvinyl pyrrolidone, polyacrylamide, hydroxypropyl cellulose, polyvinyl imidazoline, and polyhydroxyethylmethacrylate. Other water-soluble polymers may include the polyethylene oxides generally known as POLYOX (available from Union Carbide Corporation) or ALKOX (available from Meisei Chemical Works, Kyota, Japan). These polyethylene oxides may have molecular weights of about 100,000 to 6 million, for example, about 300,000 to 5 million. The polyethylene oxide may comprise a blend of about 40 to 80% of polyethylene oxide having an average molecular weight of about 5 million (e.g., POLYOX COAGULANT) and about 60 to 20% of polyethylene oxide having an average molecular weight of about 300,000 (e.g., POLYOX WSR-N-750). The polyethylene oxide blend may also contain up to about 10% by weight of a low molecular weight (i.e., MW<10,000) polyethylene glycol such as PEG-100.

The shaving aid composite may also optionally include an inclusion complex of a skin-soothing agent with a cylcodextrin, low molecular weight water-soluble release enhancing agents such as polyethylene glycol (e.g., 1-10% by weight), water-swellable release enhancing agents such as cross-linked polyacrylics (e.g., 2-7% by weight), colorants, antioxidants, preservatives, microbicidal agents, beard softeners, astringents, depilatories, medicinal agents, conditioning agents, moisturizers, cooling agents, etc.

Figure 2:
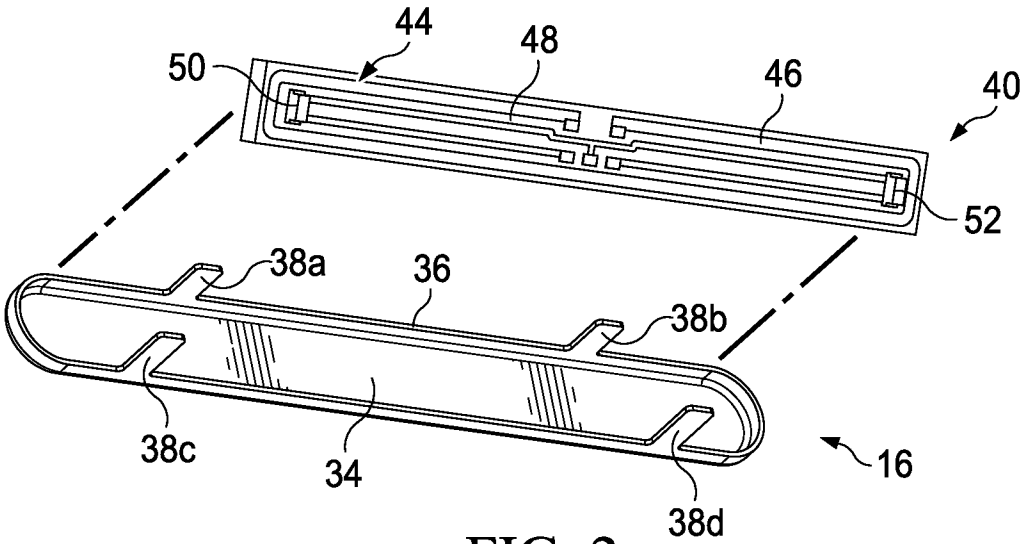
FIG. 2 is an assembly view of one possible embodiment of a heating element and insulating member that may be incorporated into the shaving razor system of FIG. 1.

Referring to FIG. 2, one possible embodiment of a heating element is shown that may be incorporated into the shaving razor system of FIG. 1. The heating element 16 may have a bottom surface 34 opposing the skin contacting surface 30. A perimeter wall 36 may define the bottom surface 34. The perimeter wall 36 may have one or more legs 38 extending from the perimeter wall 36, transverse to and away from the bottom surface 34. For example, FIG. 2 illustrates four legs 38 extending from the perimeter wall 36. As will be explained in greater detail below, the legs 38 may facilitate locating and securing the heating element 16 during the assembly process. An insulating member 40 may be positioned within the perimeter wall 36. In certain embodiments, the insulating member 40 may comprise a ceramic or other materials having high thermal conductivity and/or excellent electrical insulator properties. The insulating member 40 may have first surface 42 (see FIG. 3) that faces the bottom surface 34 of the heating element and a second surface 44 opposite the first surface 42. The perimeter wall 36 may help contain and locate the insulating member 40. In certain embodiments, the insulating member 40 may be secured to the bottom surface 34 by various bonding techniques generally known to those skilled in the art. It is understood that the perimeter wall 36 may be continuous or segmented (e.g., a plurality of legs or castellations).

The second surface 44 of the insulating member 40 may comprise a conductive heating track 46 that extends around a perimeter of the insulating member 40. An electrical circuit track 48 may also extend around a perimeter of the second surface 44. In certain embodiments, the electrical circuit track 48 may be positioned within the heating track 46. The electrical circuit track 48 may be spaced apart from the heating track 46. The electrical circuit track 48 may comprise a pair of thermal sensors 50 and 52 that are positioned on opposite lateral ends (e.g., on left and right sides) of the second surface 44 of the insulating member 40. In certain embodiments, the thermal sensors 50 and 52 may be NTC-type thermal sensors (negative temperature coefficient).

The positioning of the thermal sensors 50 and 52 opposite lateral ends of the second surface 44 of the insulating member 40 may provide for a safer and more reliable measurement of the temperature of the heating element 16 (e.g., the bottom surface 34) and/or the insulating member 40. For example, if only one end of the heating element is exposed to cool water (e.g., when the shaving razor cartridge is being rinsed in between shaving strokes), that end of the heating element will be cooler than the other end of the heating element. Lateral heat flow from one end to the opposite end of the heating element is typically poor. Temperature equalization is very slow and limited by the heat resistance of the mechanical heater system. Accordingly, a single sensor or multiple sensor(s) that take an average temperature will not provide an accurate reading and may over heat the heating element, which may lead to burning of the skin. Power to the heating element 16 may never turn off because of the unbalanced temperature of the heating element 16 (i.e., the average temperature or the individual temperature of the single sensor exposed to the cool water may never be reached). Accordingly, the thermal sensors 50, 52 may independently output a signal related to the temperature of the heating element 16 to the temperature control circuit, which is in electrical communication with the thermal sensors 50, 52.

Similarly, if only one end of the heating element 16 is exposed to hot water (e.g., when the shaving razor cartridge is being rinsed in between shaving strokes), that end of the heating element will be hotter than the other end of the heating element 16. Accordingly, a single sensor or multiple sensor(s) that take an average temperature will not provide an accurate reading and may result in power to the heating element being cut off or reduced prematurely (resulting in the consumer not feeling a heating sensation during shaving). The thermal sensors 50 and 52 may also be spaced apart from the heating track 46 to provide a more accurate temperature reading. For example, thermal sensors 50 and 52 may be spaced apart by about 3 mm to about 30 mm depending on the desired accuracy and manufacturing costs. In certain embodiments, a protective coating may be layered over the electrical circuit track 48 and/or the heating track 46. If desired, the entire second surface may be covered in a protective coating (e.g., to prevent water ingress which may damage the sensors 50 and 52, the electrical circuit track 48 and/or the heating track 46).

Figure 3:
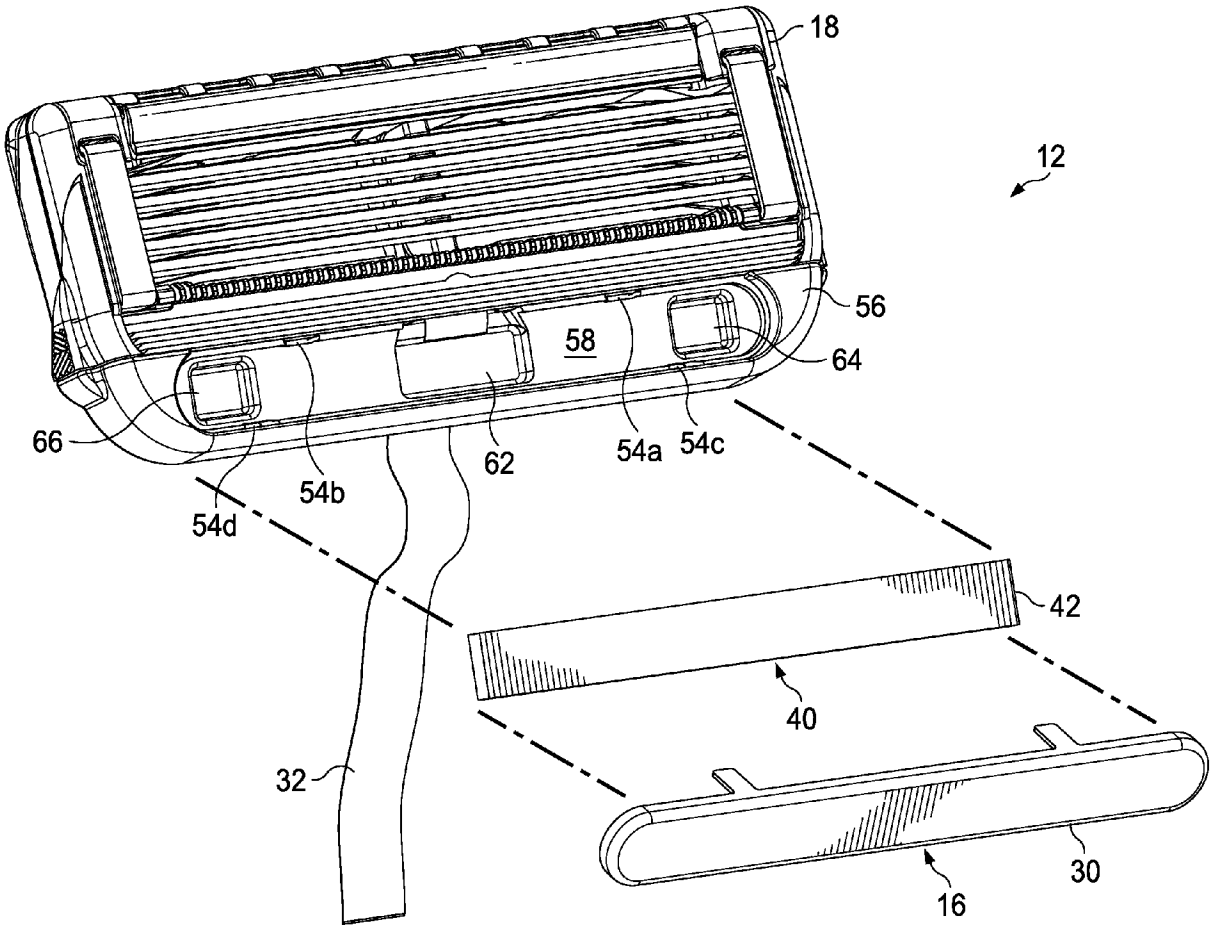
FIG. 3 is an assembly view of the shaving razor cartridge of FIG. 1.
Figure 4:
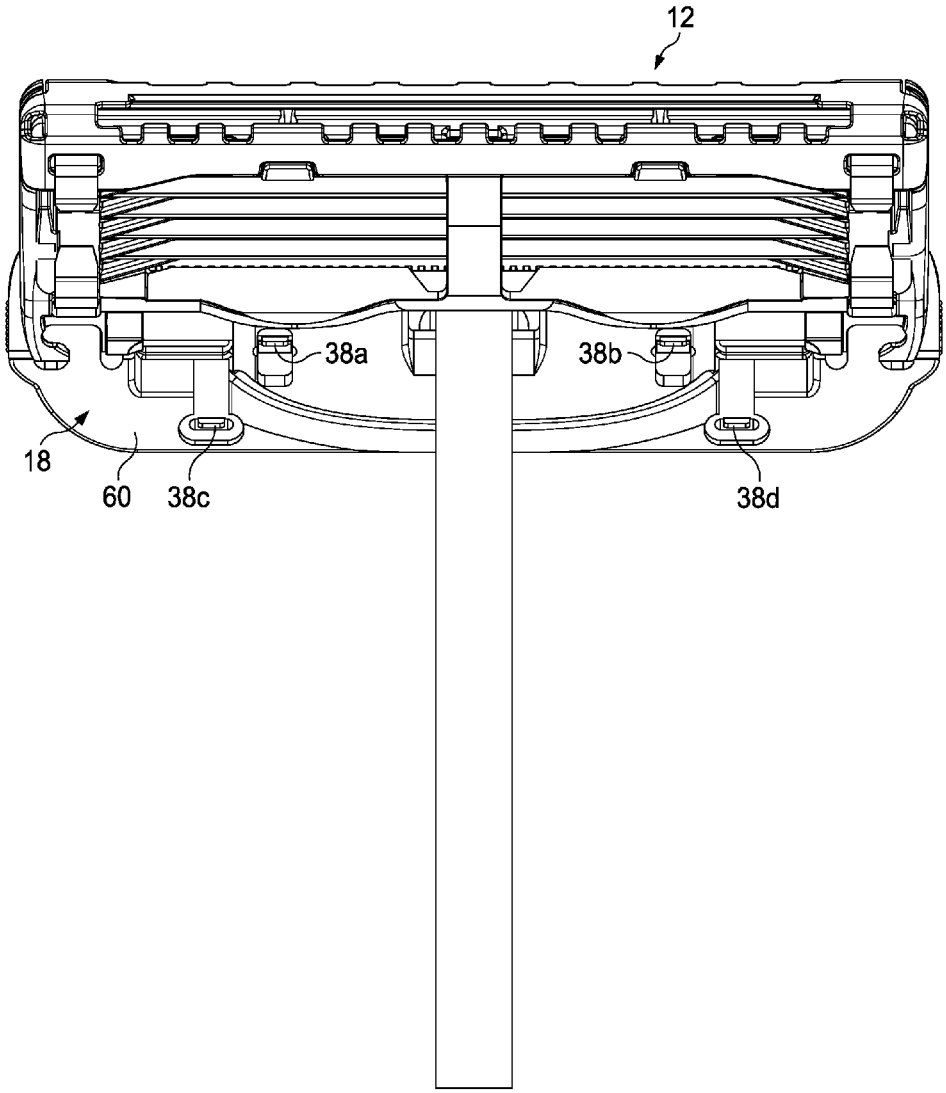
FIG. 4 is a bottom view of the shaving cartridge of FIG. 3
Figure 5:
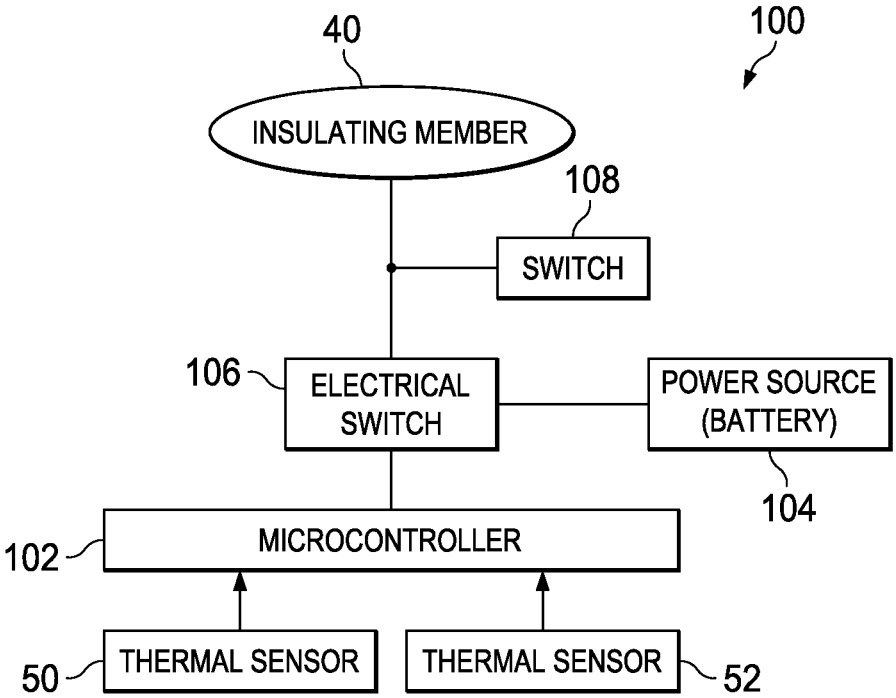
FIG. 5 is a schematic view of an electrical circuit, which may be incorporated into the shaving razor system of FIG. 1.

Referring to FIG. 3, an assembly view of the shaving razor cartridge 12 is shown. The housing 18 may define a plurality of openings 54*a*, 54*b*, 54*c* and 54*d* extending into a top surface 56. In certain embodiments, the top surface 56 may have a recess 58 dimensioned to receive the heating element 16. The plurality of openings 54*a*, 54*b*, 54*c* and 54*d* may extend from the top surface 56 thru the housing 18 to a bottom surface 60 of the housing 18 (see FIG. 4). The insulating member 40 may be assembled to the heating element 16 prior to attaching the heating element 16 to the housing 18. Each of the legs 38*a*, 38*b*, 38*c* and 38*d* (as shown in FIG. 2) may extend into one of the corresponding openings 54*a*, 54*b*, 54*c* and 54*d* to align the heating element 16 within the recess 58 and secure the heating element 16 to the housing 18. In certain embodiments, each of the legs 38*a*, 38*b*, 38*c* and 38*d* may extend thru the bottom surface 60 and about a portion of the bottom surface 60 of the housing 18 to secure the heating element 16 to the housing 18 (as shown in FIG. 4). The recess 58 may define an aperture dimensioned to hold a portion 62 of the flexible circuit 32 supplying power to the heating track 44 and the electrical track 48. As will be described in greater detail below, the flexible circuit 32 may also carry a signal from the sensors 50 and 52 via the electrical circuit to a microcontroller. The housing 18 may have a pair of spaced apart recesses 64 and 66 dimensioned to receive the thermal sensors 50 and 52 (shown in FIG. 2). The spaced apart recesses 64 and 66 may extend deeper into the housing 18 (i.e., top surface 56) than the recess 58 to allow the skin contacting surface 30 to be generally flush with top surface 56 of the housing 18. The spaced apart recesses 64 and 66 may be positioned within the recess 58. Referring to FIG. 5, a schematic circuit diagram is illustrated that may be incorporated into the shaving razor system of FIG. 1 to control the temperature of the heating element 16 and/or the insulating member 40. FIG. 5 shows one possible example of an electrical circuit 100 that includes a temperature control circuit 102 (e.g., a microcontroller) for adjusting power to the insulating member 40, thus controlling the temperature of the heating element 16. In certain embodiments, the temperature control circuit 102 (as well as other components of the electrical circuit 100) may be positioned within the handle 14. The main function of the control circuit 100 is to control the heating element 16 temperature to a set temperature within a reasonable tolerance band by controlling power to the insulating member 40. The temperature control circuit 102 may run in cycles of 10 microseconds, (e.g. after this period the state of the heater can change (on or off) and during this period the value of the thermal sensors 50 and 52 are monitored and processed in the temperature control circuit 102).

One or more desired target temperatures may be stored in the temperature control circuit 102 (i.e., the predetermined value). In certain embodiments, the desired target temperatures may be converted to a corresponding value that is stored in the microcontroller. For example, the microcontroller may store a first temperature value (or a corresponding value) for a "target temperature" and a second temperature value (or a corresponding value) for a "maximum temperature". The temperature control circuit 102 storing and comparing two different values (e.g., one for target temperature and one for maximum temperature) may provide for a more balanced temperature of the heating element and prevent overheating.

The heating element 16 may have different states. One state may be a balanced state (i.e., temperature across the length of the heating element 16 is fairly consistent). The balanced state may represent normal or typical shaving conditions (e.g., entire length of heating element 16 touches the skin during a shaving stroke so heat is dissipated evenly). The temperature control circuit 102 may calculate an average temperature output from the thermal sensors 50 and 52 (i.e., the average temperature sensed by the sensors 50 and 52). The temperature control circuit 102 may compare the average temperature output to a first predetermined value (e.g., the target temperature) that is stored in the microcontroller. It is understood that the term temperature values may be interpreted as numerical values, which are derived from electrical parameters which correlate to the temperature (e.g., electrical resistance).

The heating element 16 may also have a second state, which may be an unbalanced state where the temperature across the length of the heating element 16 is not consistent (e.g., varies by more than 1 Celsius). The temperature control circuit 102 may compare individual temperature output values (i.e., an electrical signal related to a temperature of the heating element) from each sensor 50 and 52 with a second predetermined value (e.g., maximum temperature) that is greater than the first predetermined value, which is stored in the temperature control circuit 102. Accordingly, the microcontroller may store both the first predetermined value (e.g., 48 Celsius) and the second predetermined value (e.g., 50 Celsius).

As previously mentioned, in certain embodiments, the desired target temperatures may be converted to a corresponding value that is stored by the temperature control circuit 102. For example, the sensors 50 and 52 may generate an output value for a resistance (e.g., R1 and R2, respectively) based on a sensor temperature output (i.e., temperature sensed by sensors 50 and 52 of the heating element 16). R1 and R2 may each be converted to a voltage that is converted to a numerical value or data that is compared to one or more predetermined values stored in the temperature control circuit 102. The power from the power source 104 to the insulating member 40 may be turned off by the temperature control circuit 102 sending a signal to an electrical switch 106 to cut off power to the insulating member 40 by opening or closing the electrical switch 106 (i.e., open position power is off, closed position power is on). A switch 108 may also be provided, such as a mechanical switch, for the consumer control (e.g., turn on/off the power to the insulating member 40).

In certain embodiments, optimum safety and performance may be delivered if the microcontroller performs the following functions based on the output temperatures of the thermal sensors 50 and 52. If the output temperature of one or both thermal sensors 50 and 52 are above or equal to the second predetermined temperature (e.g., maximum temperature) then power from the power source 104 to the insulating member 40 is switched off (e.g., electrical switch 106 is in open position preventing power from reaching the insulating member 40). If the output temperature of both thermal sensors 50 and 52 are above or equal to the first predetermined temperature (e.g., target temperature) then the heater is switched off. If the output temperature of both thermal sensors 50 and 52 are below the first predetermined temperature (e.g., target temperature) then power to the insulating member 40 is switched on (e.g., electrical switch 106 is in close position allowing power to the insulating member 40). If one of the output temperatures of the thermal sensors 50 and 52 is below and the other one is above or equal to the first predetermined temperature (e.g., target temperature), power to the insulating member 40 is only switched on if the difference between the colder sensor temperature and first predetermined temperature (e.g., target temperature) is larger than the difference between the warmer sensor temperature and the first predetermined temperature (e.g., target temperature). In other embodiments, the electrical switch may be opened (power to insulating member 40 turned off) anytime either sensor temperature (50 or 52) is greater than or equal to the second predetermined value. In yet other embodiments, the microcontroller may send a signal to the electrical switch to cut off power to the insulating member 40 if either the average value is greater than the first predetermined value or the individual value sensor temperatures is greater than the second predetermined. The heating element 16 may never be allowed to reach a temperature greater than or equal the second predetermined value (e.g., 50 Celsius). In certain embodiments, the first predetermined value may be about 46 Celsius to about 50 Celsius (e.g., about 48 Celsius plus/minus about 2 Celsius) and the second predetermined value may be greater than or equal to 50 Celsius to about 60 Celsius (e.g., about 55 Celsius plus/minus about 5 Celsius). In certain embodiments, the first predetermined value may be less than the second predetermined value by about 2 Celsius or more.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor system comprising:

a housing comprising a guard, a cap, and one or more blades located between the guard and the cap, said guard being positioned in front of said one or more blades, said cap being positioned behind said one or more blades, a heating element in front of the one or more blades for transferring heat during a shaving stroke, said heating element comprising a skin contacting surface;

an insulating member for delivering heat to the heating element;

an electrical circuit configured to deliver energy to the insulating member, the electrical circuit comprising a control circuit for temperature regulation;

a power source in communication with the electrical circuit;

a plurality of spaced apart thermal sensors directly mounted to the insulating member and positioned below the skin contacting surface, wherein the thermal sensors independently output a temperature of the heating element and are in communication with the control circuit.

2. The shaving razor system of claim 1 wherein the control circuit decreases power to the insulating member if an average temperature of the thermal sensors is greater than or equal to a predetermined temperature value.

3. The shaving razor system of claim 2 wherein the temperature control circuit comprises a microcontroller that stores the predetermined temperature value and sends a signal to an electrical switch to open and close.

4. The shaving razor system of claim 2 wherein the temperature control circuit shuts off power to the insulating member if the temperature output of either thermal sensor is greater than or equal to the predetermined temperature.

5. The shaving razor system of claim 4 wherein the predetermined temperature is greater than 50 C.

6. A shaving razor system comprising:

a heating element for transferring heat during a shaving stroke, said heating element comprising a skin contacting surface;

an insulating member for delivering heat to the heating element;

an electrical circuit configured to deliver energy to the insulating member, the electrical circuit comprising a control circuit for temperature regulation;

a power source in communication with the electrical circuit;

a plurality of spaced apart thermal sensors directly mounted to the insulating member and positioned below the skin contacting surface, wherein the thermal sensors measure the temperature of the heating element and are in communication with the control circuit;

the control circuit decreases power to the insulating member if an average temperature sensed by the thermal sensors is greater than or equal to a first predetermined temperature; and the control circuit decreases power to the insulating member if an individual temperature sensed by either of the thermal sensors is greater than or equal to a second predetermined temperature that is greater than the first predetermined temperature.

7. The shaving razor system of claim 6 wherein the control circuit shuts off power to the insulating member if the average temperature sensed by the thermal sensors is greater than or equal to the first predetermined temperature.

8. The shaving razor system of claim 6 wherein the control circuit shuts off power to the insulating member if the individual temperature sensed by either of the thermal sensors is greater than or equal to the second predetermined temperature.

9. The shaving razor system of claim 6 wherein the first predetermined temperature is about 46° C. to about 50° C.

10. The shaving razor system of claim 6 wherein the second predetermined temperature is about 50° C. to about 60° C.

11. The shaving razor system of claim 6 wherein the first predetermined temperature is greater than the second predetermined temperature by at least about 2° C.

12. The shaving razor system of claim 6 further comprising a housing having a guard, a cap, and at least one blade between the guard and the cap, said guard being positioned in front of the at least one blade and the cap being positioned behind the at least one blade, wherein the heating element is mounted to the housing and the skin contacting surface is positioned in front of the at least one blade.

13. The shaving razor shaving razor system of claim 6 further comprising an electrical switch operatively connected to the insulating member and the power source, the electrical switch having an open position for stopping power from flowing from the power source to the insulating member and a closed position for facilitating power to flow from the power source to the insulating member.

14. The shaving razor system of claim 6 wherein the thermal sensors are spaced apart by about 3 mm to about 30 mm.

* * * * *